US007503357B2

(12) United States Patent
Chuang

(10) Patent No.: US 7,503,357 B2
(45) Date of Patent: Mar. 17, 2009

(54) SWIFTLY ADJUSTING DEVICE FOR A BLADE SHAFT OF A PLANER

(76) Inventor: Bor-Yann Chuang, No. 78, Yungfeng Rd., Taiping City, Taichung (TW) 411

( * ) Notice: Subject to any disclaimer, the term of this patent is extended or adjusted under 35 U.S.C. 154(b) by 452 days.

(21) Appl. No.: 11/410,080

(22) Filed: Apr. 25, 2006

(65) Prior Publication Data

US 2007/0245870 A1 Oct. 25, 2007

(51) Int. Cl.
*B27C 1/00* (2006.01)
*B27C 5/02* (2006.01)

(52) U.S. Cl. ..... 144/114.1; 144/117.1; 144/253.5; 144/253.8

(58) Field of Classification Search ..... 144/114.1, 144/117.1, 253.1, 253.5–253.9; 269/303, 269/315, 318; 83/471.3
See application file for complete search history.

(56) References Cited

U.S. PATENT DOCUMENTS 5,143,128 A * 9/1992 Chen ..... 144/117.1
5,213,457 A * 5/1993 Maas et al. ..... 409/175
2005/0194063 A1 * 9/2005 Bettacchini ..... 144/117.1

* cited by examiner

*Primary Examiner*—Shelley Self
(74) *Attorney, Agent, or Firm*—Ming Chow; Sinorica, LLC

(57) ABSTRACT

A swiftly adjusting device for a blade shaft of a planer includes a blade shaft movably positioned in a blade opening of a worktable superposed on a machine body. The machine body has an adjusting hollow space formed in a front portion, and the adjusting hollow space has an adjusting member pivotally connected with a center portion and movable up and down. The blade shaft has an adjusting bearing support pivotally connected to a front end and received in the adjusting hollow space. The bottom of the adjusting bearing support contacts the upper end of the adjusting member so that the blade shaft can be minutely and swiftly adjusted in its level to the worktable by adjusting the adjusting member in a minute way.

3 Claims, 7 Drawing Sheets

SWIFTLY ADJUSTING DEVICE FOR A BLADE SHAFT OF A PLANER

BACKGROUND OF THE INVENTION

1. Field of the Invention

This invention relates to a swiftly adjusting device for a blade shaft of a planer, particularly to one possible to minutely adjust the position of a blade shaft of a manual planer with swiftness.

2. Description of the Prior Art

A conventional planer shown in FIGS. 1 and 2 includes a body 11, a worktable 11 fixed on the body 11 for placing a work thereon to be planed, a blade shaft 12 positioned in the center opening of the work table 111 and driven by a motor (not shown) to plane the work placed on the worktable 111. The blade shaft 12 is pivotally supported by a bearing fitted in a bearing support 13 respectively at two ends, and the body 11 is provided with a bearing support recess 112 respectively at two sides for receiving the two bearing supports 13. Each bearing support recess 112 has a vertical hole 113 extending from its bottom down in the body 11, and each bearing support 13 has a threaded hole 131 to align to the vertical hole 113. So when the bearing support 13 is fitted in the bearing support recess 112, an elongate bolt 114 extends in the vertical hole 112 and then engages with the threaded hole 131 to be tightly fixed on the body 11 and accordingly the blade shaft 12 can be fixed tightly on the body 11.

However, the bearing supports 13 are tightly fixed on the body 11 with bolts, if the blade shaft 12 is needed to be adjusted in its level, or to be taken off, the elongate bolts 114 have to be disengaged from the bottom of the body 11 at first. Thus it takes much time for adjusting or taking off the blade shaft 12. Further, in adjusting the elongate bolts 114, it cannot be seen owing to its low position, requiring many times of testing, quite troublesome.

SUMMARY OF THE INVENTION

The feature of the invention is an adjusting hollow space provided in a front portion of a machine body of a planer, an adjusting member movably combined under the bottom of the center of the adjusting hollow space, and an adjusting bearing support pivotally connected to a blade shaft located in a shaft opening in the center portion of the work table fixed on the machine body. The adjusting bearing support is received in the adjusting hollow space, having its bottom contacting the upper end of the adjusting member so that the blade shaft can be minutely and swiftly adjusted in its level to the worktable by screwing up and down the adjusting member in a minute way to move up and down minutely the adjusting bearing support in the adjusting hollow space.

BRIEF DESCRIPTION OF DRAWINGS

This invention will be better understood by referring to the accompanying drawings, wherein.

DETAILED DESCRIPTION OF THE PREFERRED EMBODIMENT

Figure 1:
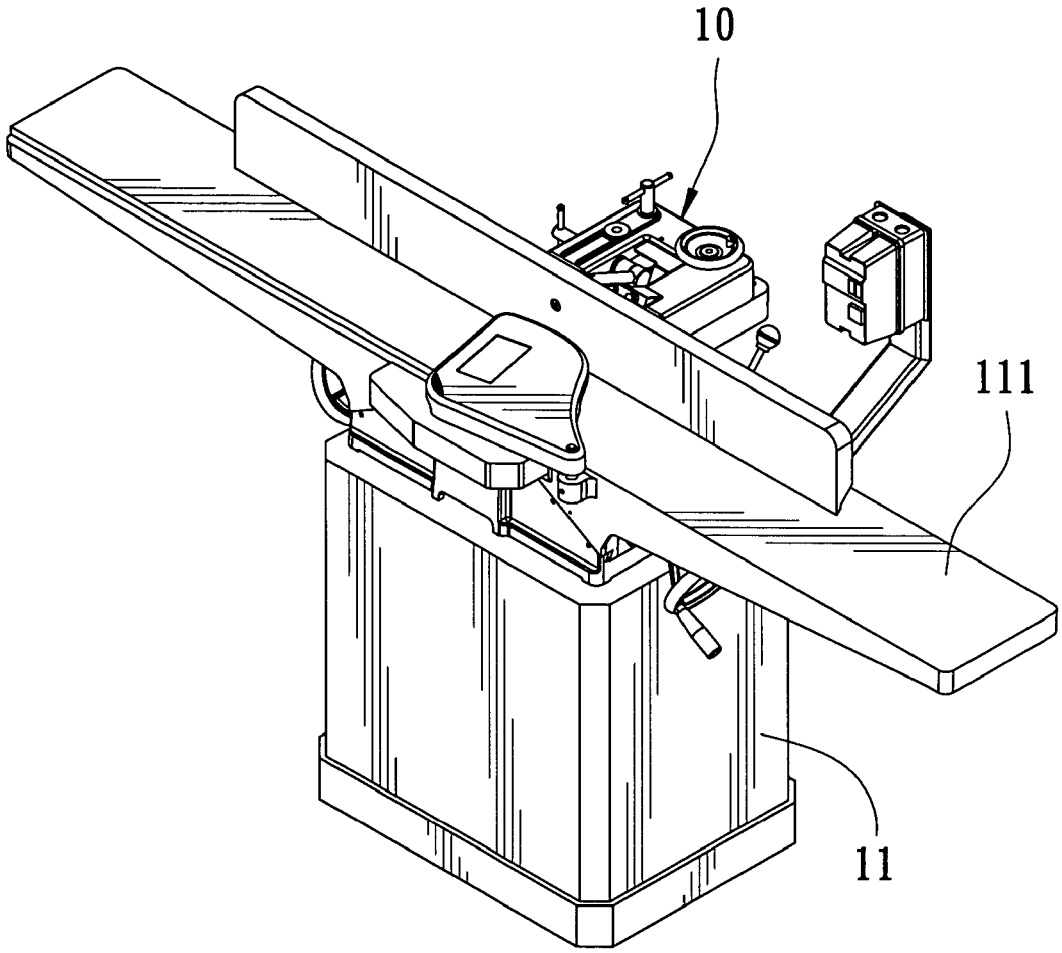
FIG. 1 PRIOR ART
FIG. 1 is a perspective view of a conventional planer.
Figure 2:
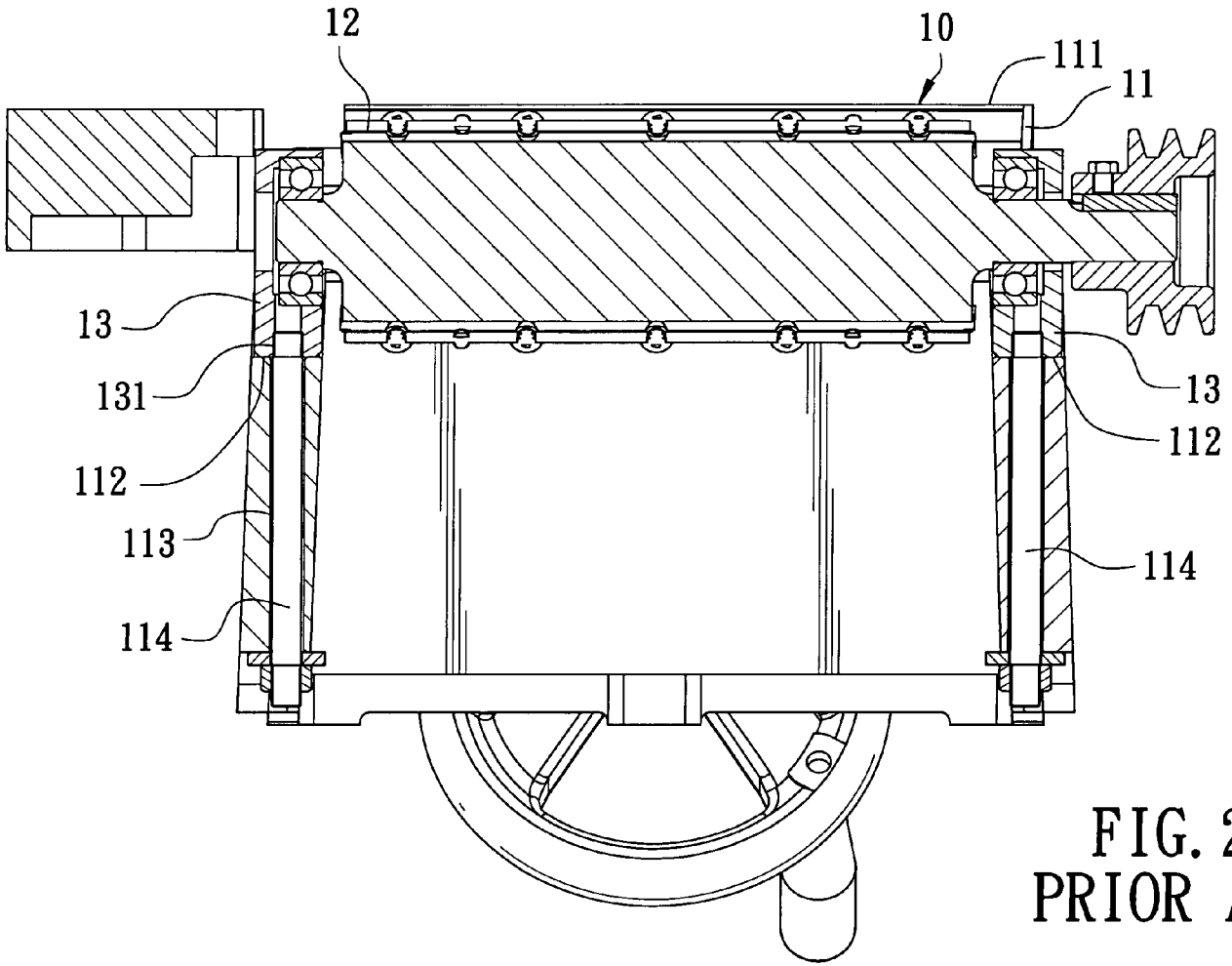
FIG. 2 PRIOR ART
FIG. 2 is a cross-sectional view of the conventional planer.
Figure 3:
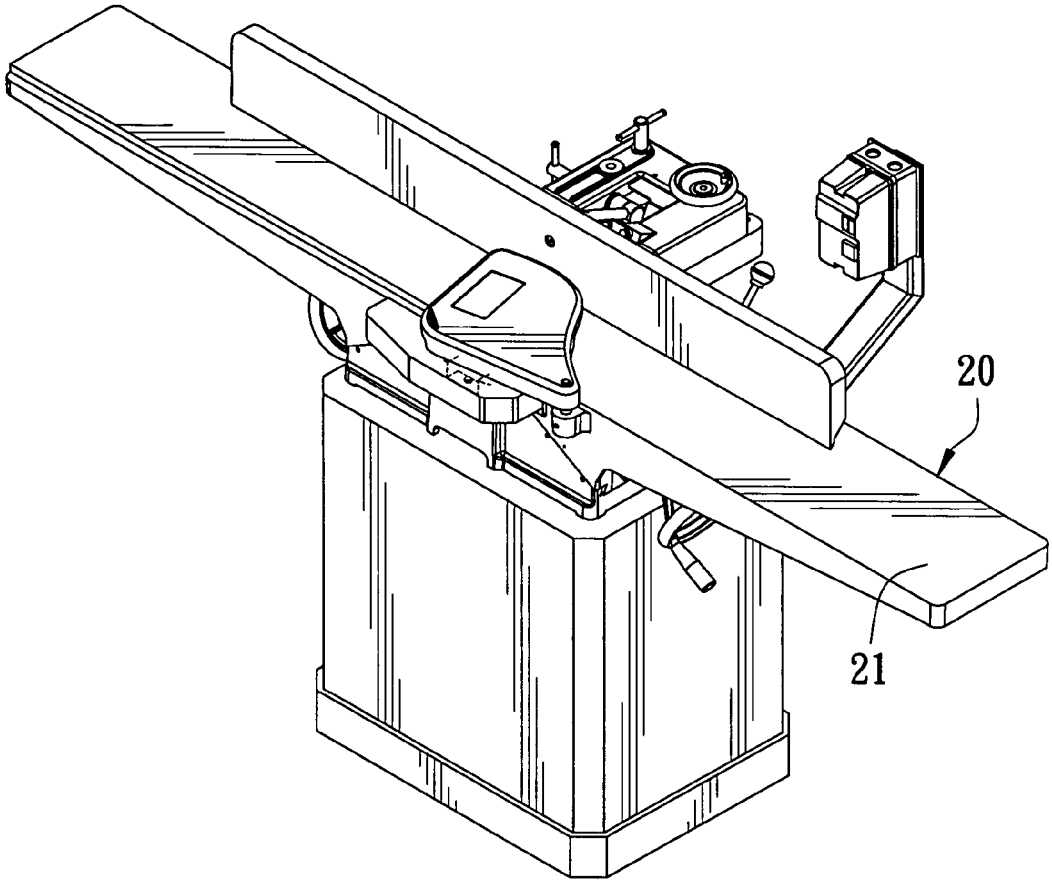
FIG. 3 is a perspective view of a planer with a swiftly adjusting device for a blade shaft in the present invention.
Figure 4:
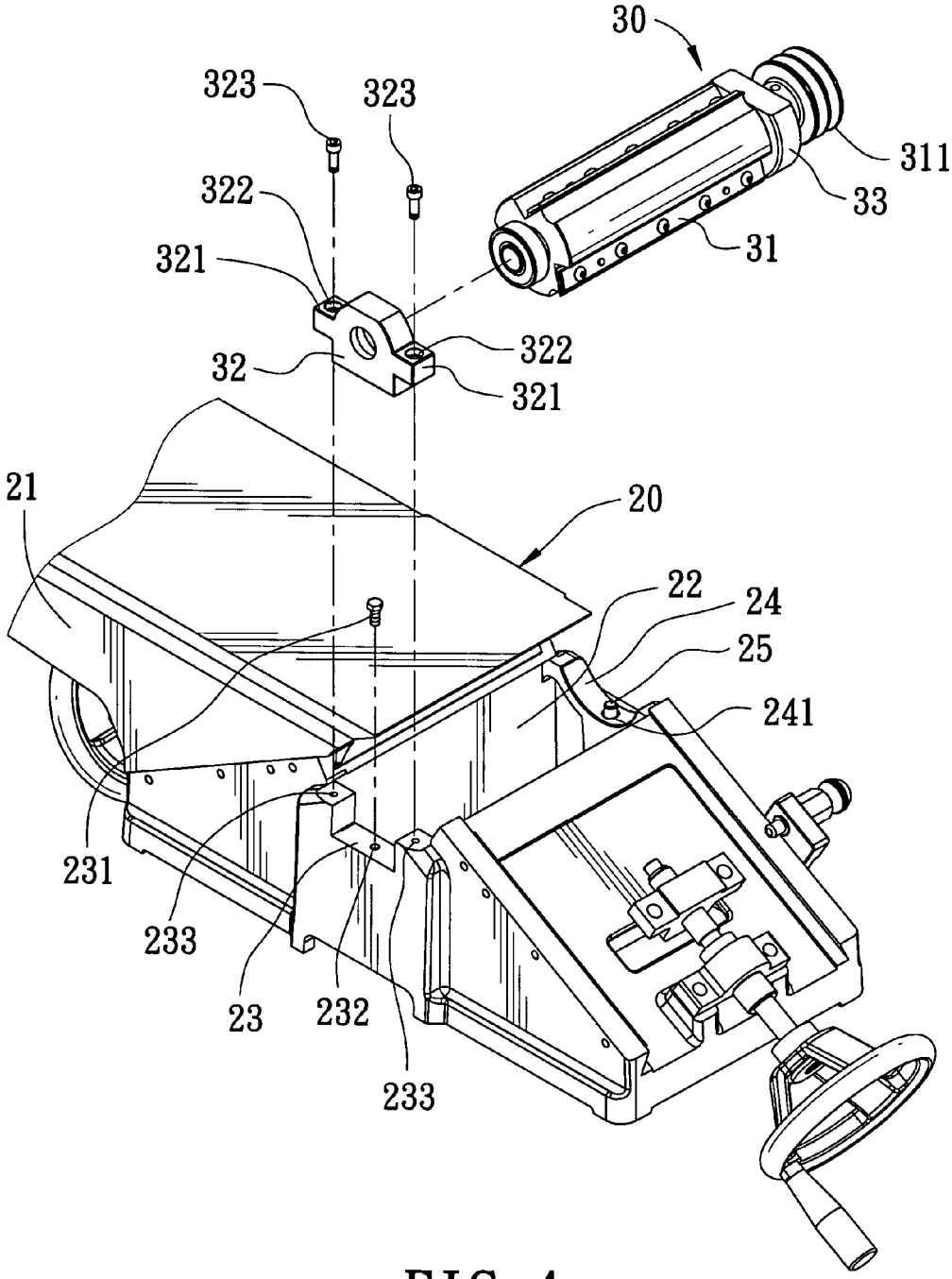
FIG. 4 is a partial exploded perspective view of the swiftly adjusting device for a blade shaft of a planer in the present invention.
Figure 5:
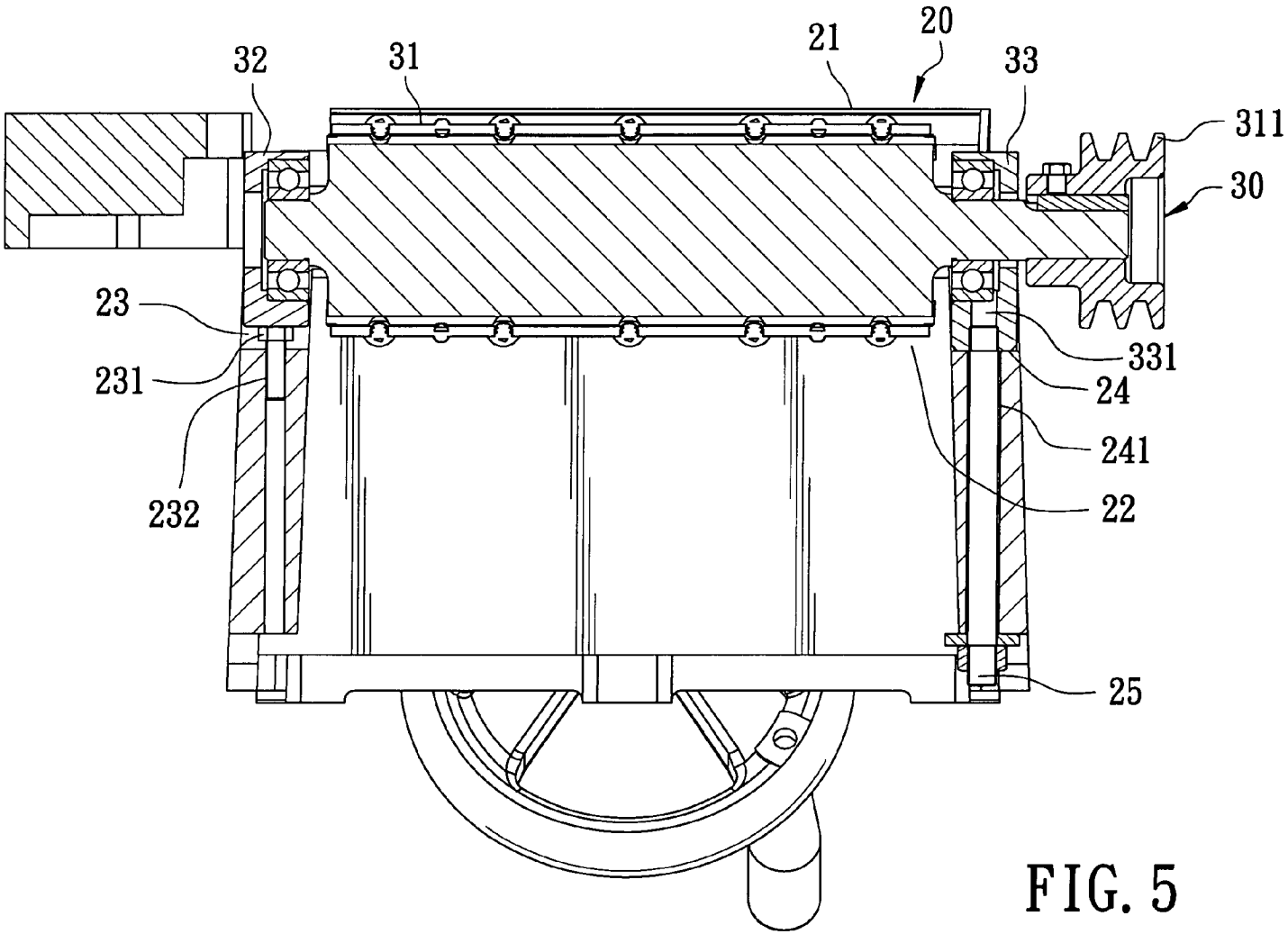
FIG. 5 is a cross-sectional view of the blade shaft in the present invention.

A preferred embodiment of a swiftly adjusting device for a blade shaft of a planer in the present invention, as shown in FIGS. 3, 4, and 5, includes a blade shaft 30 adjustably combined with a machine body 20.

The machine body 20 has a worktable 21 fixed on an upper side, and a blade opening 22 is formed in a center portion of the worktable 21, so the blade shaft 30 may be pivotally combined in the blade opening 22.

The machine body 20 is provided with an adjusting hollow space 23 formed in a location in a front portion facing the blade opening 22, an adjusting member 231 fitted under the bottom of the adjusting hollow space 23. The adjusting member 231 is a bolt and nut engaging an adjusting threaded hole 232 formed in the machine body 20 just under the adjusting hollow space 23. Further, two fixing threaded holes 233 are formed at two sides of the adjusting hollow space 23. The machine body 20 is also provided with a curved recess 24 formed in a rear side and corresponding to the adjusting hollow space 23, and the curved recess 24 has a vertical hole 241 in its center, with an elongate bolt 25 extending in the vertical hole 241.

The blade shaft 30 has a shaft body 31 positioned in the blade opening 22, and a belt pulley 311 is fixed at a first end of the shaft body 31, connected with and driven by a motor (not shown) of the machine body 20. The blade shaft 30 has a second end pivotally connected to an adjusting bearing support 32, which has a projection 321 respectively at two sides. Each projection 321 has a stepped hole 322 to align to the fix threaded hole 233 of the adjusting hollow space 23, with a bolt 323 engaging the fix threaded hole 233, and with the bottom of the adjusting bearing support 32 contacting the upper end of the adjusting member 231. Further, the first end of the blade shaft 30 is fitted with a bearing support 33, which is received in the curved recess 24 and has a threaded hole 331 aligned to the elongate hole 241 of the machine body 20 for the elongate bolt 25 to engage to keep the bearing support 33 tightly in the curved recess 24.

Figure 6:
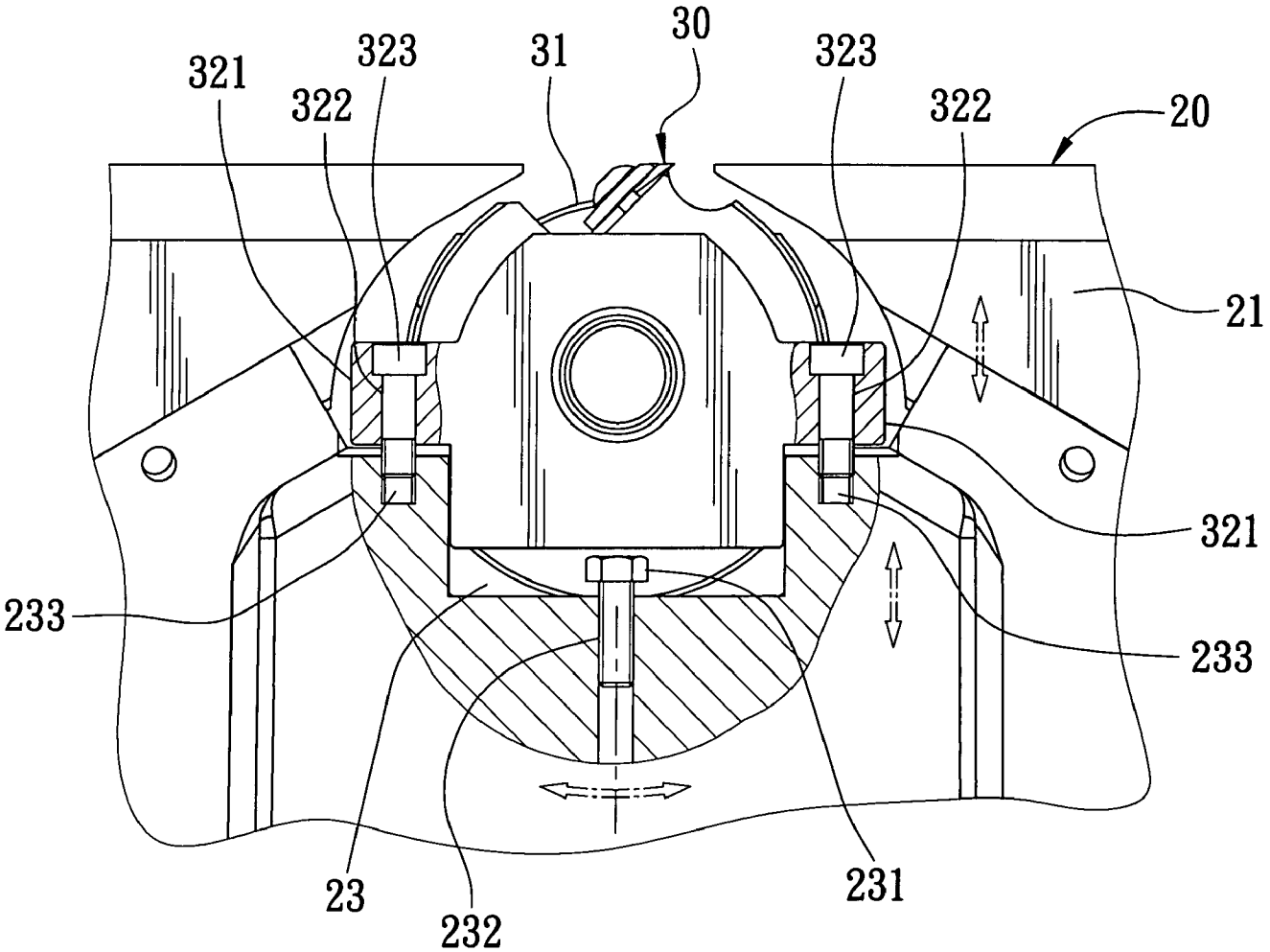
FIG. 6 is a cross-sectional view of the blade shaft being adjusted in its level to a worktable of a planer in the present invention; and, FIG. 7 is a cross-sectional view of the blade shaft finished in adjusting its level to the worktable of a planer in the present invention.
Figure 7:
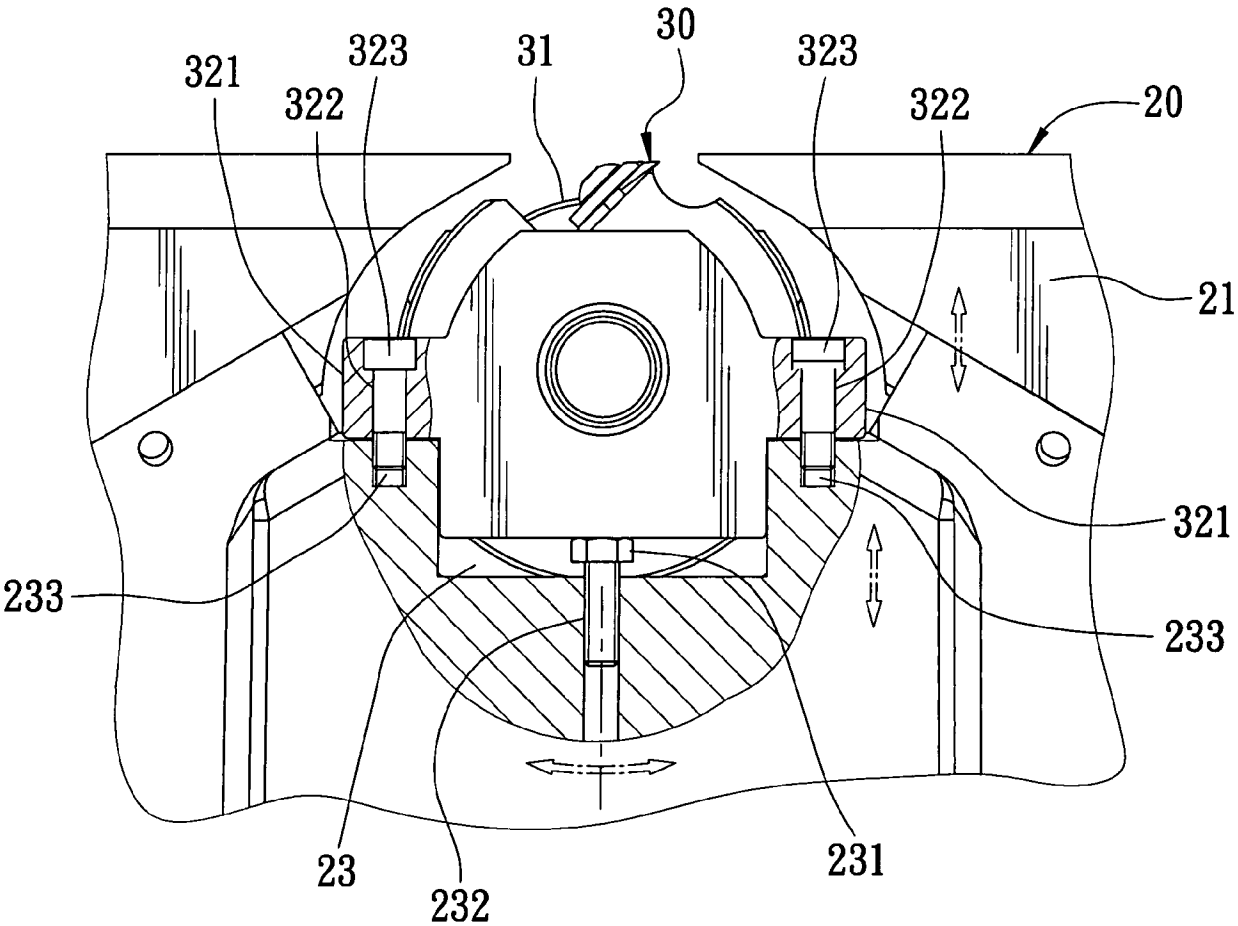

Next, how to adjust the blade shaft 30 in its level to the worktable 21 is to be described as follows. As shown in FIGS. 5 and 6, when the blade shaft 30 is positioned in the machine body 20, the elongate bolt 25 engages with the threaded hole 331 of the bearing support 33, and the bolts 323 of the adjusting bearing supports 32 engage with the fix threaded holes 323. If the blades on the blade shaft 30 are wanted to be replaced with new ones or the blade shaft 30 has to be adjusted in the level to the worktable 21, the bolts 323 of the adjusting bearing support 32 are firstly to be screwed loose, and then possible to be moved up or down very minutely, with the adjusting member 231 under the adjusting hollow space 23 being screwed loose at the same time and possible to be moved up or down very minutely. As the position of the adjusting member 231 is moved a bit minutely to contact the bottom of the adjusting bearing support 32, which is then also moved to change its position accordingly in a minute way. Therefore, the level of the blade shaft 30 to the worktable 21 can be adjusted minutely up or down. After the adjustment, the bolts 323 are tightly screwed again, letting the adjusting bearing support 32 is secured at the adjusted position in the adjusting hollow space 23, with the bottom of the adjusting bearing support 32 contacting and upheld by the upper end of the adjusting member 231.

So the swift adjusting device for a blade shaft of a planer can make the adjusting bearing support to swiftly shift its position in a minute way, saving time in adjustment and upgrading its effectiveness.

While the preferred embodiment of the invention has been described above, it will be recognized and understood that various modifications may be made therein and the appended claims are intended to cover all such modifications that may fall within the spirit and scope of the invention.

What is claimed is:

1. A swiftly adjusting device for a blade shaft of a planer, said device comprising:

a blade shaft pivotally connected to a machine body of a planer and having a first end being fixed with a belt pulley for a belt extending around a spindle of a motor that is being fixed in said machine body, wherein said blade shaft being rotated by said pulley so that planing blades fixed on said blade shaft may plane a work;

said machine body being provided with an adjusting hollow space formed in a front end of a left longitudinal side of the machine body;

an adjusting member pivotally connected with a center of said adjusting hollow space wherein the adjusting member moves up and down in said adjusting hollow space, said machine body also provided with a curved recess formed in a front end of a right longitudinal side corresponding to said adjusting hollow space;

said curved recess having a hole in a center of the curved recess wherein an elongate bolt passing upward through said hole from a lower portion of said machine body;

said blade shaft having a second end pivotally connected with an adjusting bearing support;

said adjusting bearing support received in said adjusting hollow space of said machine body;

said adjusting bearing support having a bottom contacting an upper end of said adjusting member;

said first end of said blade shaft pivotally connected with a bearing support;

said bearing support received in said curved recess of said machine body; and said bearing support provided with a threaded hole in said bottom for a bolt to engage with.

2. The swiftly adjusting device for a blade shaft of a planer as claimed in claim 1, wherein said adjusting member comprises a bolt and nuts; and said adjusting hollow space is provided with an adjusting threaded hole in the bottom wherein an adjusting bolt being engaged with the adjusting threaded hole.

3. The swiftly adjusting device for a blade shaft of a planer as claimed in claim 1, wherein said machine body further has a threaded hole respectively at two sides of said adjusting hollow space; and said adjusting bearing support of said blade shaft has a projection at two sides, with said projection provided with a hole aligned to each of said threaded hole of said machine body for an elongate bolt to engage therein upward.

* * * * *